US012195251B2

(12) United States Patent
Andrews et al.

(10) Patent No.: US 12,195,251 B2
(45) Date of Patent: Jan. 14, 2025

(54) STRAW GRIPPER AND TAB SEPARATOR FOR DISPOSABLE CUP OR LID AND METHODS OF USE

(71) Applicants: David Andrews, Atlanta, GA (US); Paul DeMoss, Atlanta, GA (US); Henry Wischusen, III, Duluth, GA (US)

(72) Inventors: David Andrews, Atlanta, GA (US); Paul DeMoss, Atlanta, GA (US); Henry Wischusen, III, Duluth, GA (US)

( * ) Notice: Subject to any disclaimer, the term of this patent is extended or adjusted under 35 U.S.C. 154(b) by 27 days.

(21) Appl. No.: 18/174,905

(22) Filed: Feb. 27, 2023

(65) Prior Publication Data

US 2024/0286807 A1 Aug. 29, 2024

(51) Int. Cl.
*B65D 51/24* (2006.01)
*B65D 1/26* (2006.01)

(52) U.S. Cl.
CPC ..... *B65D 51/24* (2013.01); *B65D 1/265* (2013.01); *B65D 2231/022* (2013.01); *B65D 2543/00092* (2013.01)

(58) Field of Classification Search
CPC .. B65D 51/24; B65D 1/265; B65D 2231/022; B65D 2543/00092; B65D 77/283; B65D 77/286
USPC ..... 220/705, 708, 718, 735, 709, 710
See application file for complete search history.

(56) References Cited

U.S. PATENT DOCUMENTS 2,844,267 A * 7/1958 Petriccione ..... B65D 77/283 215/229
2,885,134 A * 5/1959 Cohen ..... B65D 1/265 215/389
5,048,709 A * 9/1991 Alverson ..... B65D 77/28 215/229
5,150,811 A 9/1992 Kelston
5,178,354 A 1/1993 Engvall
(Continued)

FOREIGN PATENT DOCUMENTS

EP 1486149 12/2004
NL 1029632 C1 1/2007

OTHER PUBLICATIONS

International Search Authority, "International Search Report" and "Written Opinion", PCT/US24/17108, mailed on Jun. 17, 2024.

*Primary Examiner* — Steven A. Reynolds
*Assistant Examiner* — Prince Pal
(74) *Attorney, Agent, or Firm* — Mathew L. Grell, Esq.; Grell & Watson Patent Attorneys LLC

(57) ABSTRACT

A straw gripper and tab separator for disposable cup or lid having a tab extending from the perimeter of the drink lid/cup, the tab having an exterior edge with a straw capture and alignment port to align the straw with said exterior edge, the straw capture and alignment port having a slit dividing the planar tab into a first tab section and second tab section, the first tab section having a first straw contact finger configured therein and the second tab section having a second straw contact finger configured therein, each straw contact finger separated by said slit, the straw contact fingers cutout endpoints converge on a second slit end, and the straw contact fingers are hingeably configured to removably secure the straw against a straw contact rim formed in the planar tab by a cutout of said first straw contact finger and said second straw contact finger.

21 Claims, 15 Drawing Sheets

(56) References Cited

U.S. PATENT DOCUMENTS 5,325,982 A * 7/1994 Cobb, Jr. ..... A47G 19/2222 215/396
5,484,065 A * 1/1996 Davoli, Jr. ..... A47K 1/09 215/390
D373,050 S * 8/1996 Brewer ..... D7/505
5,544,783 A 8/1996 Conigliaro
5,676,306 A * 10/1997 Lankin ..... B65D 3/20 229/5.5
5,772,084 A * 6/1998 Yale ..... B65D 83/303 222/402.1
5,806,669 A * 9/1998 Kim ..... B65D 83/285 206/349
5,988,575 A * 11/1999 Lesko ..... B65D 69/00 24/339
6,123,189 A * 9/2000 Falkenberg ..... B65D 77/283 206/217
6,176,390 B1 * 1/2001 Kemp ..... B65D 47/06 222/454
6,196,411 B1 * 3/2001 Nava ..... B65D 51/20 206/217
7,299,922 B2 * 11/2007 Ceballos ..... A47K 1/09 206/362.1
8,464,888 B2 * 6/2013 Hayashi ..... B65D 47/36 215/229
8,464,896 B2 6/2013 Beary
D790,913 S 7/2017 Stover et al.
D798,105 S * 9/2017 Stover ..... D7/396.2
10,085,576 B1 * 10/2018 Juarbe ..... A47G 21/182
10,143,318 B2 * 12/2018 Shaffer ..... A47G 19/06
10,420,434 B1 * 9/2019 Juarbe ..... A47G 19/2227
2007/0170188 A1 7/2007 Guillaume
2008/0011909 A1 * 1/2008 Daddario ..... A47G 19/2222 248/65
2008/0203104 A1 * 8/2008 Pawlik ..... A47G 19/2222 220/710
2009/0188929 A1 * 7/2009 Sims ..... A47G 19/2205 220/500
2009/0283535 A1 * 11/2009 Mesalic ..... B65D 43/0212 220/709
2009/0308882 A1 * 12/2009 Hundley ..... B65D 47/2031 220/712
2012/0205389 A1 * 8/2012 Beary ..... A47G 19/2222 220/710
2013/0270144 A1 * 10/2013 Nowzari ..... B65D 77/24 206/459.5
2015/0056339 A1 2/2015 Vaes
2017/0112308 A1 * 4/2017 Bennevendo ..... A47G 19/2266
2019/0084717 A1 * 3/2019 Bjurenheim ..... B65D 51/222
2020/0055640 A1 * 2/2020 Lee ..... A47G 19/2272
2021/0282585 A1 9/2021 Lee
2022/0194652 A1 * 6/2022 Mikkelsen ..... B31B 50/745
2024/0081563 A1 * 3/2024 Stroh ..... A47G 19/2222

* cited by examiner

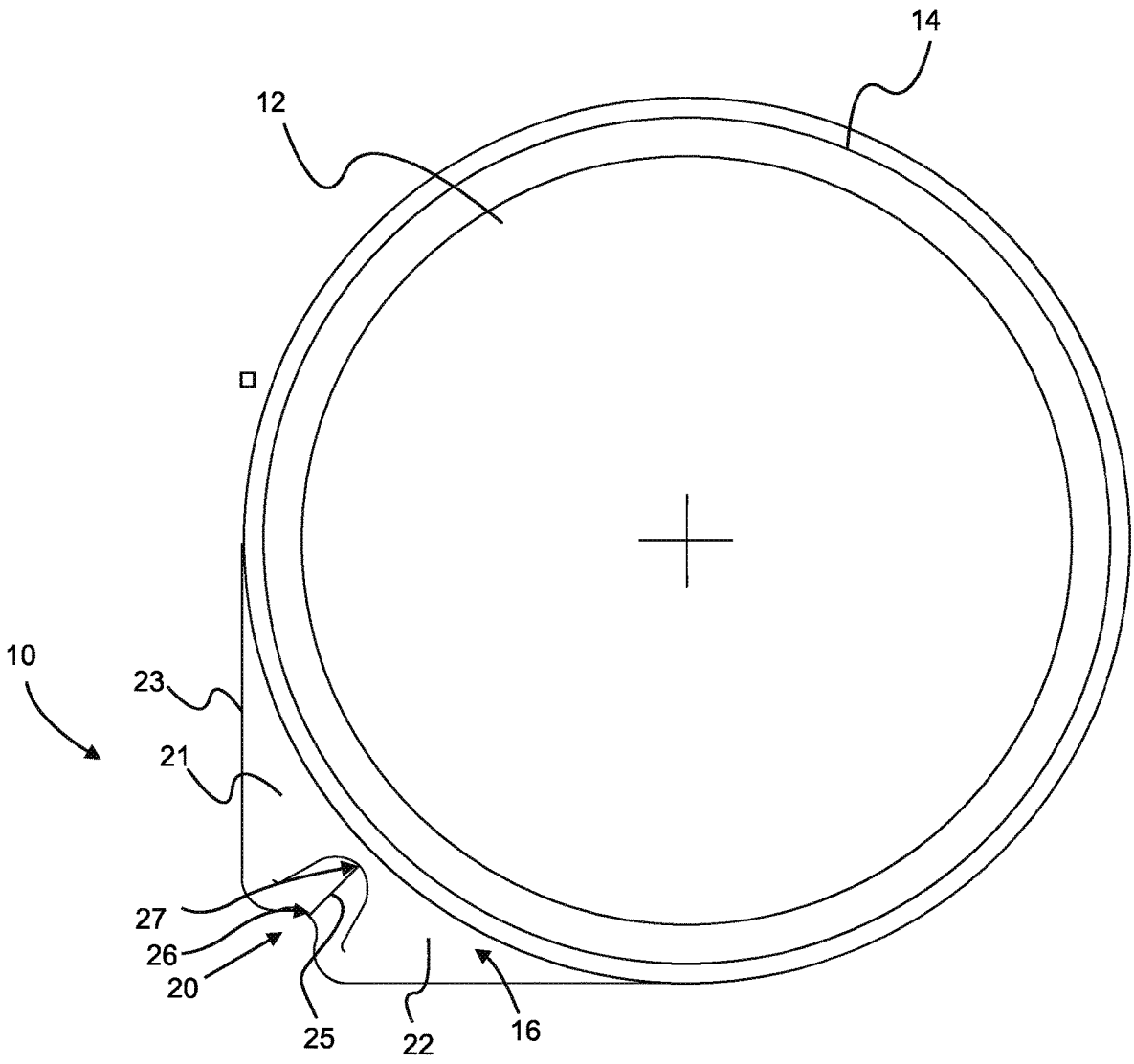
Fig. 2.1

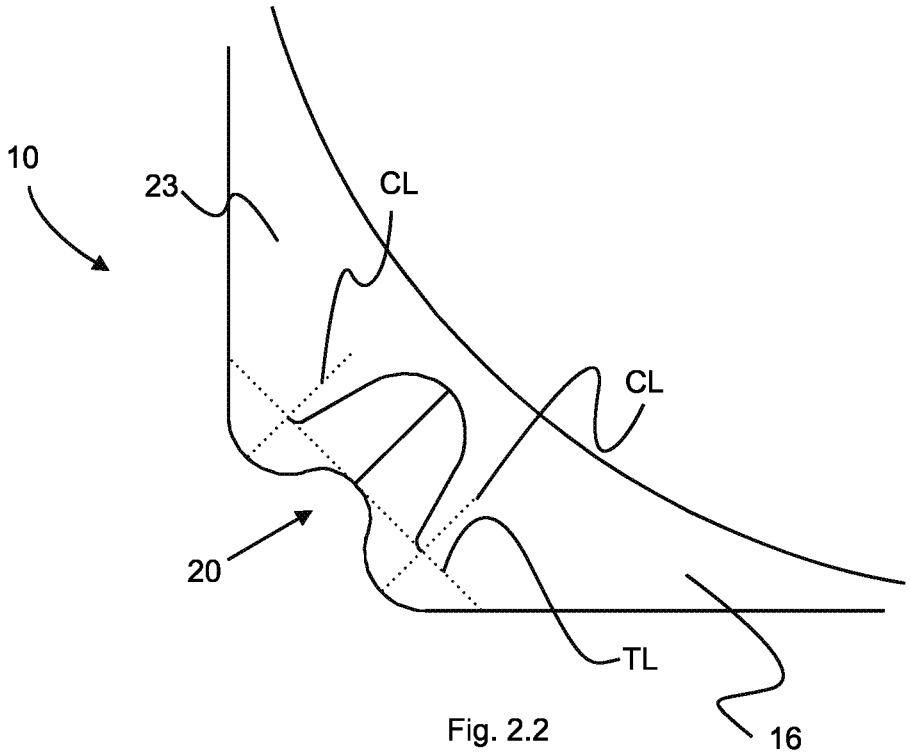
Fig. 2.2

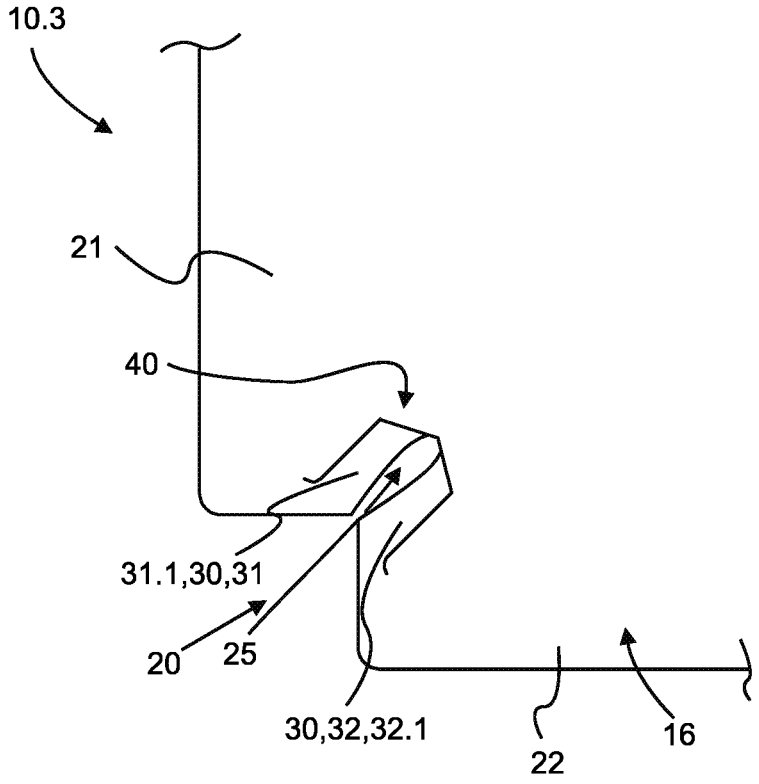
Fig. 3.1

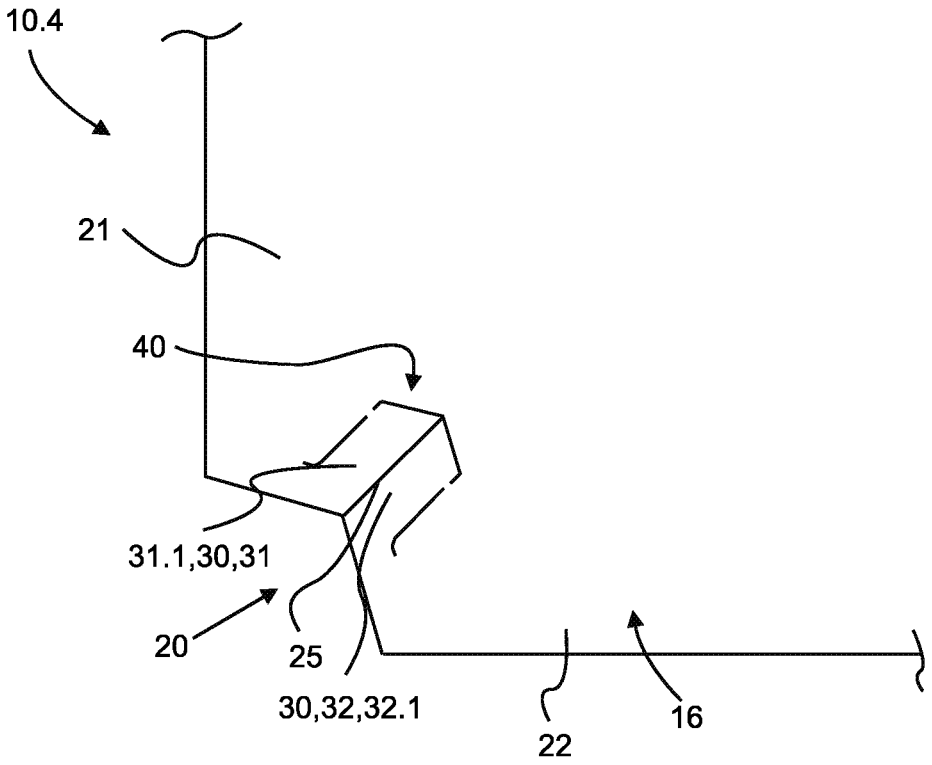
Fig. 3.2

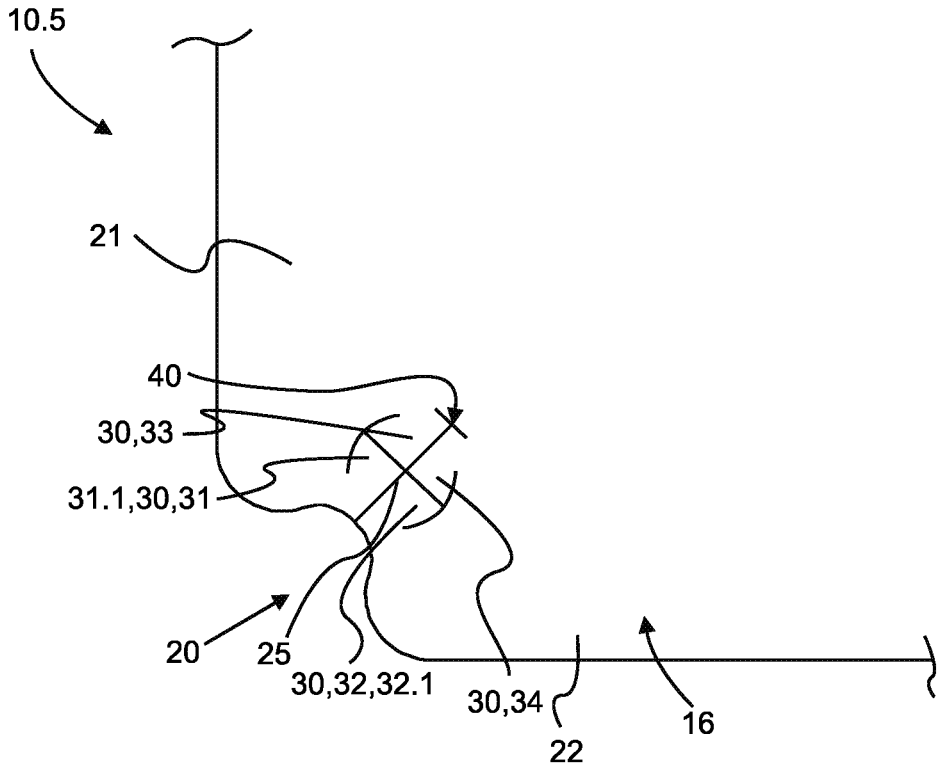
Fig. 3.3

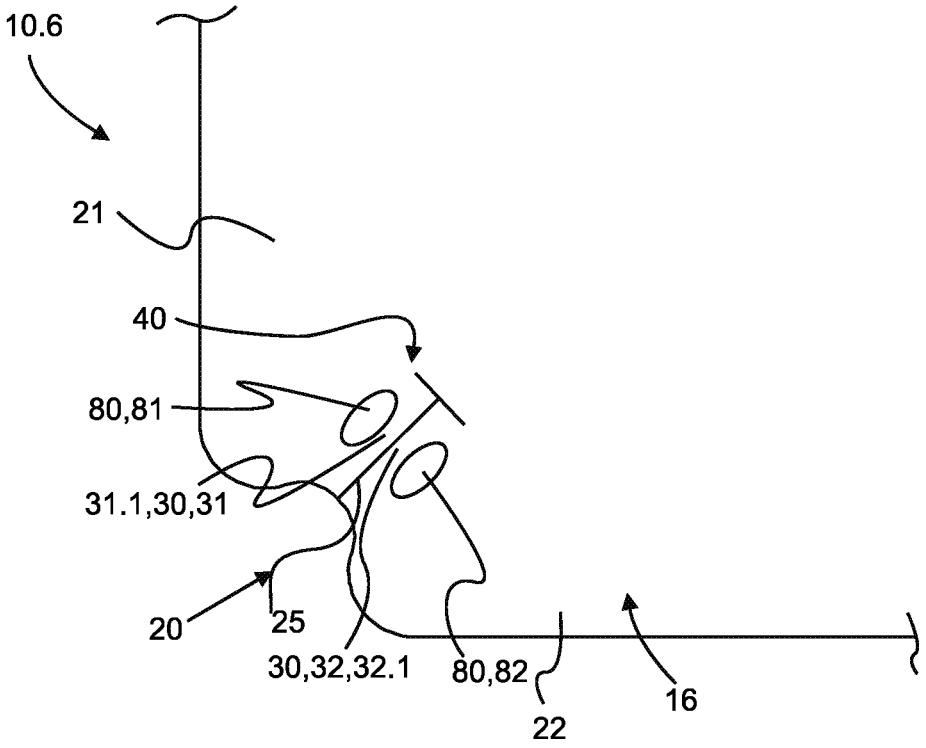
Fig. 3.4

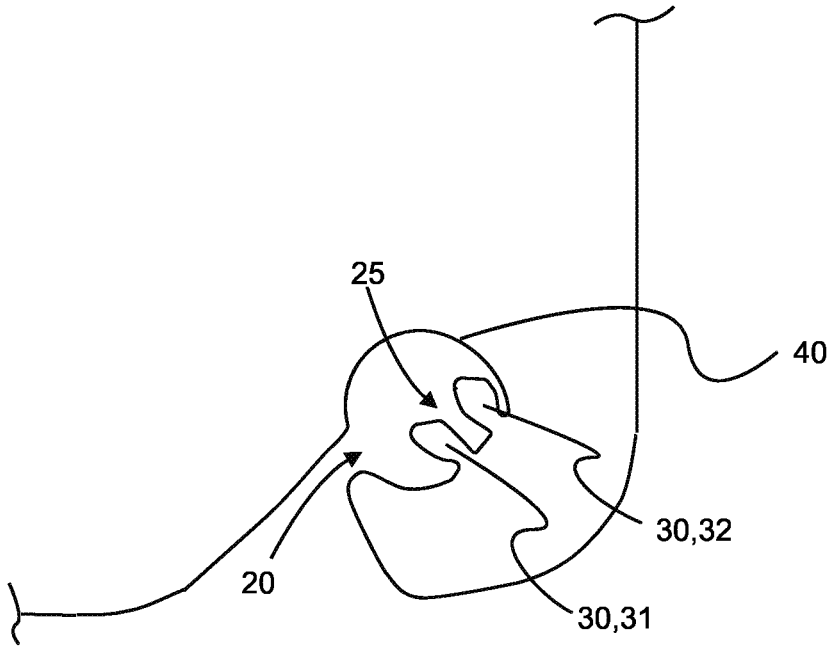
Fig. 3.5

STRAW GRIPPER AND TAB SEPARATOR FOR DISPOSABLE CUP OR LID AND METHODS OF USE

FIELD OF THE DISCLOSURE

The present disclosure is directed to on-the-go drink containers. More specifically, the present disclosure is directed to an apparatus to secure a straw to the portable drink container.

BACKGROUND

Quick-service food and fast casual dining establishments provide customers with low-cost disposable beverage cups (especially for soda drinks) and lids to add structure to the cup and prevent spilling while in transport; such lids require a straw to access fluid in the container or cup with a lid. Straws provide safety advantages compared to sipping beverages without straws (with or without sip lids); appropriate material straws are required (for cold and hot drinks) for persons with a spectrum of physical challenges.

Carrying and transporting a drinking straw with a disposable beverage cup is inconvenient. When consumers order a beverage with other food items, the drinking straw(s) is generally placed in a bag with the food items; frequently, the presence of a straw is not readily apparent. Inside food and beverage establishments and drive-thru windows at said locations, service workers often hold a cup and straw in one hand while transferring the cup and straw to a customer's hand in a precarious maneuver. Furthermore, in-store, to-go customers often have to locate straws in crowded environments.

Customers are frequently inconvenienced at drive-thru windows, in-store counters, and delivery locations by asking, "Is there a straw(s) in the bag?" Unfortunately, addressing this common customer concern is time-consuming for food & beverage and delivery service workers and operations.

Food and beverage establishment workers, and delivery drivers, have been frustrated when separating disposable cup lids from lid stacks (removing from shipping boxes and various types of counter racks and displays); it is difficult to separate a single lid, or a plurality of lids, without touching the backside of one or more lids. Sometimes lids fall on the floor, and workers place the fallen, dirty lids on customers' cups. Workers frequently touch the back of cup lids—when attempting to remove one or more lids from a stack—and often, workers will throw out lids that have been mishandled (for hygiene reasons). This problem is costing businesses money in wasted packaging and lost time (in a low-margin business where seconds and savings matter).

Another disadvantage with conventional disposable cup lids, and lid storage and display systems, a drink or soda attendant (or customer) grabs the rim of the top lid in the stack, and a percentage of the time will collect more than one lid, forcing the attendant to separate the lids to get to an individual lid. Next, the attendant often tosses the remainder of the lids into the trash rather than placing them back on the stack. Moreover, if the attendant takes the time to place the touched lids back on the stack, this activity may leave the remainder lids in an unsanitary state.

Therefore, it is readily apparent that there is a recognizable unmet need for a straw gripper and tab separator for disposable cup lid and methods of use that may be configured to address at least some aspects of the problems discussed above.

SUMMARY

Briefly described, in an example embodiment, the present disclosure may overcome the above-mentioned disadvantages and may meet the recognized need for a straw gripper and tab separator for disposable cup lid and methods of use to provide an apparatus to secure the straw to the lid or cup, the preferred apparatus having a tab extending from the perimeter of the drink lid/cup, the tab having an exterior edge with a straw capture and alignment port to align the straw with said exterior edge, the straw capture and alignment port having a slit dividing the planar tab into a first tab section and second tab section, the first tab section having a first straw contact finger configured therein and the second tab section having a second straw contact finger configured therein, each straw contact finger separated by said slit, the straw contact fingers cutout end points converge on a second slit end, and the straw contact fingers are hingeably configured to removably secure the straw against a straw contact rim formed in the planar tab by a cutout of said first straw contact finger and said second straw contact finger.

Accordingly, in one aspect, the present disclosure may enable attachment of a drinking straw (in multiple sizes) to the outside of the beverage lid of various sizes and shapes, for the purpose of visually assuring the presence of a straw during hand off and transport, and easily and safely carrying and transporting a cup with a straw attached.

Accordingly, in another aspect, the present disclosure may enable the attachment of multiple-sized wrapped and unwrapped drinking straws to the lid of various sized and configured drinking cups.

Accordingly, in another aspect, the present disclosure provides a tab to assist with storing the lids in a stack and making it easy to pluck one lid from a stack of lids.

In an exemplary embodiment of a an apparatus to secure a straw to a drink lid having a perimeter flange, the drink lid is secured to the rim of a drinking cup having a sidewall, including a planar tab extending from the perimeter flange of the drink lid, said planar tab having an exterior edge with a straw capture and alignment port to align the straw with said exterior edge, said straw capture and alignment port having a slit to divide said planar tab into a first tab section and second tab section, said slit having a first slit end and a second slit end; said first tab section having a first straw contact finger configured therein and said second tab section having a second straw contact finger configured therein, each said first straw contact finger and said second straw contact finger separated by said slit, said first straw contact finger and said second straw contact finger cutout end points converge on said second slit end; and said first straw contact finger and said second straw contact finger are hingeably configured to removably secure the straw against a straw contact rim formed in said planar tab by a cutout of said first straw contact finger and said second straw contact finger.

In a second exemplary embodiment of an apparatus to secure a straw to the rim of a drinking cup having a sidewall including a planar tab extending from the rim of the drink lid, said planar tab having an exterior edge with a straw capture and alignment port to align the straw with said exterior edge, said straw capture and alignment port having a slit to divide said planar tab into a first tab section and second tab section, said slit having a first slit end and a second slit end, said first tab section having a first straw contact finger configured therein and said second tab section having a second straw contact finger configured therein, each said first straw contact finger and said second straw contact finger separated by said slit, said first straw contact finger and said second straw contact finger cutout end points converge on said second slit end; and said first straw contact finger and said second straw contact finger are hingeably configured to removably secure the straw against a straw contact rim formed in said planar tab by a cutout of said first straw contact finger and said second straw contact finger.

It is an object of the disclosure herein to provide an easy way to distribute a straw with a bulk-dispensed beverage without prematurely placing the straw through the customary hole in the beverage lid maintaining straw in its manufactured and wrapped sterile state.

It is an object of the disclosure herein to provide a structure for the attaching of a straw to a beverage container or lid without impeding the easy stacking and storage of containers and lids.

It is an object of the disclosure herein to provide a straw-holding structure that is inexpensive to manufacture and easy to deploy in a high-volume commercial environment such as a quick-service food restaurant or other food service business.

A feature of the present disclosure includes securing any multiple-sized straws to be held with and without wrappers.

A feature of the present disclosure includes holding the straw against the body of the cup; this is helpful for insertion into disposable cup carriers and bags, and for insertion in automotive cup holders.

A feature of the present disclosure includes one or more straw support flaps or fingers with two points of contact to grip a perimeter section of the straw.

A feature of the present disclosure includes one or more straw support flaps or fingers that fold down and out when pressed upon by the straw to form gripper levers that provide additional surface area to grip the straw.

A feature of the present disclosure includes one or more straw support flaps or fingers that do not use the friction of the inside or inner edge of a circular shape to grip the straw.

A feature of the present disclosure includes one or more straw support flaps or fingers that become downward facing levers and grip the straw using the upper face or surface turned down, and utilizing spring action of the "fingers" (levers) elastic material, rather than the straw, thus allowing for multiple size straws to be gripped.

A feature of the present disclosure includes one or more straw support flaps or fingers gripping the straw and a third contact point of the straw touching the side of the cup to hold the straw alongside the cup.

A feature of the present disclosure includes a lid handling tab in combination with a straw gripper housed on the tab as a lid-handling or de-nesting (removing one or more lids from a stack of lids) device.

A feature of the present disclosure includes added consumer and public safety (assuring customers they will have a straw provides an extra measure of driving and walking safety compared to drinking a non-alcoholic beverage without a straw while driving, and while walking).

A feature of the present disclosure includes a less burdensome, and more hygienic method for disposable cup lid management; namely, the easy separation of one or more lids from a stack or pile of lids and includes providing a sanitary tab lid separator as an attachment to the drink cup.

A feature of the present disclosure includes full compliance with the Americans with Disabilities Act (ADA). A conventional plastic straw is a safety and accommodation "appliance" for physically challenged persons. The present disclosure aids this group of special needs persons, who can immediately see if they have been provided a straw with a beverage, while ordering a beverage at a drive-thru, or at a counter to take out.

A feature of the present disclosure includes the convenience of attaching a straw to a drink container, with minimal effort and no need for the user to look for the straw.

A feature of the present disclosure includes portability when the straws can easily be attached to drink containers allowing them to be taken on the go without a hassle.

A feature of the present disclosure includes being environmentally friendly by attaching one instantly visible straw to a drink container; presently, in cases where a straw is placed in a bag for customers (in-store), the customer is often unaware a straw has been provided and therefore seeks an additional straw; this circumstance increases environmental waste and business costs.

A feature of the present disclosure includes incorporating the tab design integral to the current lid design while using current manufacturing techniques without redesigning the manufacturing equipment to keep costs and utilizing the same material choices, such as polystyrene, PET, polypropylene, modern biopolymers, and the like.

A feature of the present disclosure includes its ability to hold the drinking straw vertically and in line with the cup sidewall.

A feature of the present disclosure includes the tab or lid flange facilitating the de-nesting of cup lids from boxes and lid racks before placing lids on cups. This feature improves hygiene and reduces waste; presently lids are thrown out after beverage establishment workers inadvertently separate or de-nest more than one lid and sometimes touch the inside of one or more lids.

A feature of the present disclosure includes the tab or lid flange improves the ease of removing a lid from the cup for persons who choose to add something to the cup, such as flavor, sweetener, protein powder, or the like, or to stir the contents in the cup.

A feature of the present disclosure includes one or more hinged fingers with surface contact holding a straw against a planar perimeter edge opposite the one or more hinged fingers.

These and other features of the straw gripper and tab separator for disposable cup lid and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present disclosure for a straw gripper and tab separator for disposable cup lid and methods of use will be better understood by reading the Detailed Description of the Preferred and Selected Alternate Embodiments with reference to the accompanying drawing Figures, in which like reference numerals denote similar structure and refer to like elements throughout, and in which:

FIG. 2.1 is a perspective top view of an exemplary embodiment of a drink lid with a straw gripper and tab separator shown as a front entry according to select embodiments of the disclosure;

FIG. 2.2 is a perspective top view of an exemplary embodiment of a drink lid with a straw gripper and tab separator showing the preferred position of cutout endpoints according to select embodiments of the disclosure;

FIG. 3.1 is an exploded top view of an alternate exemplary embodiment of the straw gripper and tab separator according to select embodiments of the disclosure;

FIG. 3.2 is an exploded top view of an alternate exemplary embodiment of the straw gripper and tab separator according to select embodiments of the disclosure;

FIG. 3.3 is an exploded top view of an alternate exemplary embodiment of the straw gripper and tab separator according to select embodiments of the disclosure;

FIG. 3.4 is an exploded top view of an alternate exemplary embodiment of the straw gripper and tab separator according to select embodiments of the disclosure;

FIG. 3.5 is an exploded top view of an alternate exemplary embodiment of the straw gripper and tab separator, shown as a side entry, according to select embodiments of the disclosure;

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in the figures, specific terminology is employed for clarity. The present disclosure, however, is not intended to be limited to the specific terminology selected; it is to be understood that each specific element includes all technical equivalents that operate in a similar manner to accomplish similar functions. Embodiments of the claims may, however, be embodied in many different forms and should not be construed as limited to the embodiments set forth herein. The examples set forth herein are non-limiting examples, and are merely examples among other possible examples. It is recognized herein that the optimum dimensional relationships, to include variations in size, materials, shape, form, position, connection, function and manner of operation, assembly and use, are intended to be encompassed by the present disclosure.

Figure 1:
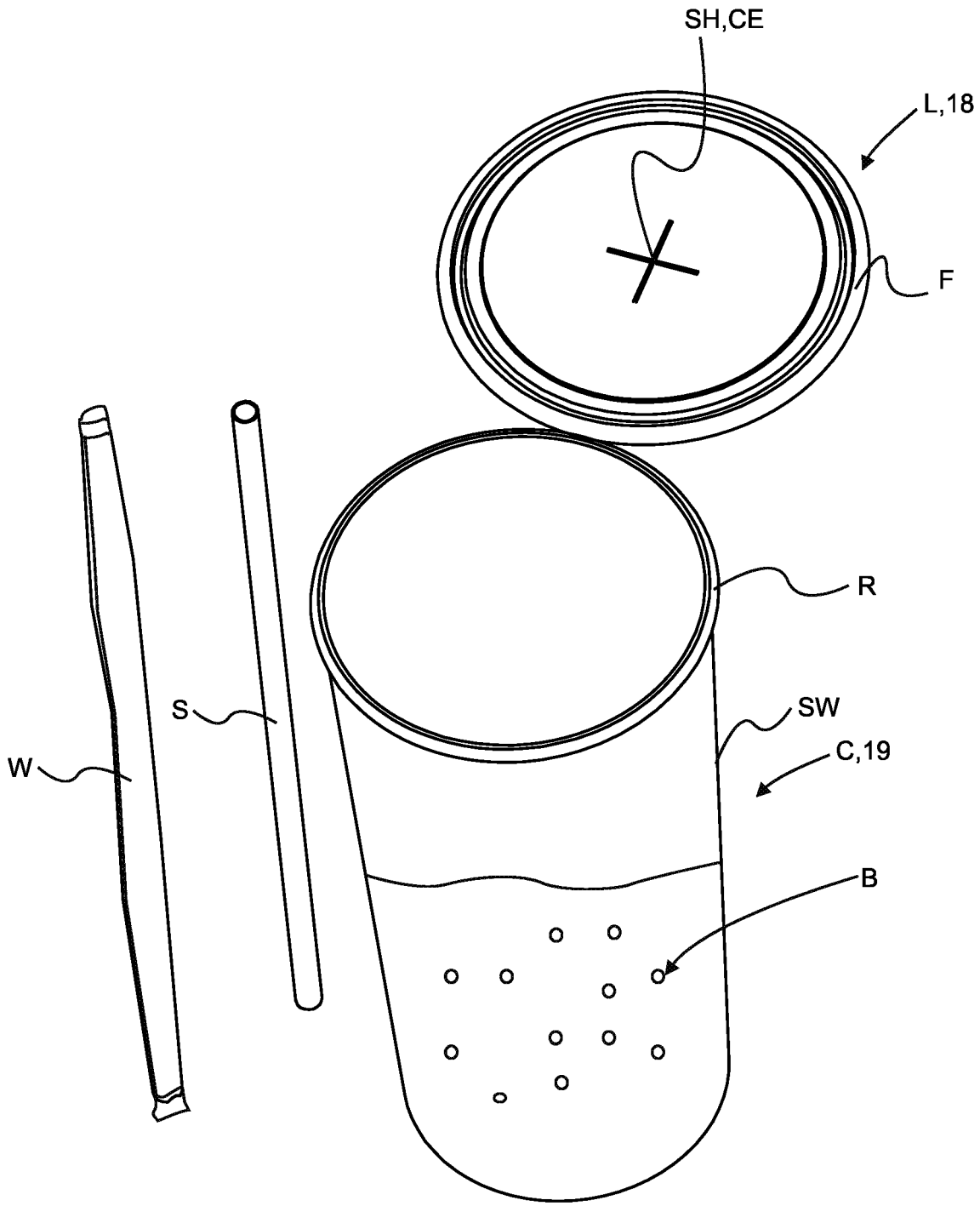
Fig. 1 Prior Art
FIG. 1 is a perspective side view of a prior art beverage container or drink cup, lid, and straw.

Referring now to FIG. 1, by way of example, and not limitation, there is illustrated an example embodiment of a prior art disposable drink cup C used as a container to hold a drink or beverage B therein, such as a soda, juice, smoothie, sports drinks other frozen or iced drinks, coffee, tea, and other hot drinks, or the like. When beverages B are purchased to take out of food and beverage establishments, beverage B is typically served in a disposable drink cup C with a disposable lid L to keep beverage B inside cup C during transport to strengthen the cup C and to prevent beverage B from spilling, sloshing, or splashing out of cup C. Disposable drink lid L may include a port or knockout or other provision therein, such as straw hole SH to provide access to beverage B as well as for insertion of straw S therethrough lid L and to submerge one end of straw S in the beverage B liquid contained therein cup C. Lid L is preferably designed to receive straw S since removing the lid L to insert straw S can be difficult and messy and contributes to a weakened cup C and possible spillage of beverage B. Straw S provides a convenient way to access beverage B with lid L in place on cup C allowing for safe consumption of beverage B while enabling the consumer to maintain unobstructed forward vision while driving or walking. It is contemplated herein that straw S may include wrapper W and that straw S herein refers to straw with or without wrapper.

It is contemplated herein that cup C and lid L may be constructed of plastic, paper, treated, wax or polymer covered paper, polystyrene, PET, polypropylene, modern bioplastics, aluminum, carbon fiber, thermoplastic material such as cellulose acetate and other suitable plastics and any other applicable materials or like material capable of manufacturing cup C and lid L to hold beverage B therein. These parts may be joined in accordance with the construction material via, welding, spot welding, epoxy, or 3D printing.

With respect to the disclosure herein, it is to be realized that the optimum dimensional relationships, including variations in size, materials, shape, form, configuration, position, connection features, function and manner of operation, assembly and use, are intended to be encompassed by the present disclosure.

Accordingly, the disclosure herein is a cup, container, or container lid, including but not limited to a container or lid or container-lid combination of the kind commonly used to distribute bulk-dispensed beverages that features an integrated component used for releasably attaching and holding a straw vertically to the outside or adjacent to the outside of the container. The integrated component may be made a part of the container or a part of the lid, and may take any of a variety of shapes, some of which are described in more detail below.

Additional features and advantages of the disclosure will be set forth in the following description, which will be apparent from the description, or may be learned by practice of the disclosure. The foregoing general description and the following detailed description are exemplary and explanatory and are intended to further explain the disclosure.

Referring now to FIGS. 2.1, 2.2, 3, 4, 5, and 6, by way of example, and not limitation, there is illustrated an example embodiment of an apparatus to seal cup C having a rim R, such as drink lid of FIG. 1 with a straw support structure or apparatus integrated thereto, such as straw gripper and tab separator 10 and its parts, according to select embodiments. In this first embodiment, lid L may include a main body preferably circular and planar, such as beverage lid 12 having perimeter flange 14 configured to conformingly couple to a top periphery or rim R of a container, such as cup C for covering the container's opening to prevent the beverage B from spilling, sloshing, or splashing out of the cup C. Moreover, lid L may include protruding planar tab 16 which extends from perimeter flange 14. Protruding planar tab 16 may include exterior edge 23 and having straw gripper and tab separator 10 integrated therein planar tab 16. Furthermore, straw gripper and tab separator 10 may be integrated therein planar tab 16 and positioned anywhere around perimeter flange 14 of lid 12. Furthermore, exterior edge 23 may include an indent, such as straw capture and alignment port 20 to align straw S with planar tab 16.

If possible, straw gripper and tab separator 10 may preferably utilize an area of material in the manufacturing form that is otherwise cut away in the production process.

Furthermore, planar tab 16 may include a cutout, separation, gap, or divide therein, such as slit 25 dividing planar tab 16 into left or first tab section 21 and right or second tab section 22, each extending as flat planar tab therefrom perimeter flange 14 of lid 12. Slit 25 may include front or first slit end 26 and back or second slit end 27. First tab section 21 and second tab section 22 may each include a portion of straw capture and alignment port 20 configured as the front end or exterior edge 23 of first tab section 21 and second tab section 22. In this embodiment, straw capture and alignment port 20 may be pointed (points), direction, or faces outward from center CE of lid 12 or configured perpendicular to the tangential of perimeter flange 14.

It is contemplated herein that straw capture and alignment port 20 may be configured as a reverse partial circular arc, such as semi-circular, in an opposite curvilinear arc as flange 14; may be configured as angled rather than arcing as well as other shapes and sizes to provide a guide and catch for straw S, 18 alignment and insertion into straw gripper and tab separator 10.

It is further contemplated herein that slit 25 may be configured as a gap or other cutout contemplated by one of ordinary skill in the art.

Still furthermore, one or both of first tab section 21 and second tab section 22 may include a series of cuts or cutouts centered relative to straw capture and alignment port 20 or slit 25 to form one or more foldable or hingeable straw contact members or flaps, such as straw contact finger(s) 30 extending in a direction toward center C of lid 12 and hinged thereto first tab section 21 proximate straw capture port 20. In a preferred embodiment, first tab section 21 may include first straw contact finger 31 and second tab section 22 may include second straw contact finger 32 centered about slit 25 and meeting together at second slit end 27 to create an opening or access therebetween first straw contact finger 31 and second straw contact finger 32. Slit 25 is preferably formed with first straw contact finger 31 and second straw contact finger 32 touching or virtually touching one another or close thereto. Moreover, first end 31.1 of first straw contact finger 31 may be connected and hinged to first tab section 21, and first end 32.1 of second straw contact finger 32 may be connected and hinged to second tab section 22. Furthermore, first straw contact finger 31 and second straw contact finger 32 may extend therein straw capture port 20 and hingedly or flexibly fold therein to form straw capture cavity 50 formed between hinged first straw contact finger 31 and second straw contact finger 32, and back rim wall of straw contact rim 40. Straw contact rim 40 may be sized and shaped to match the outer surface configuration of straw S, 18. Moreover, straw contact rim 40 is preferably proximate or touching perimeter flange 14 of lid 12. In this embodiment, first straw contact finger 31 and second straw contact finger 32 may be pointed or face inward toward center CE of lid 12 or configured perpendicular to perimeter flange 14 or the tangent thereof.

It is contemplated herein that first straw contact finger 31 and second straw contact finger 32 may be a cutout therein first tab section 21 and second tab section 22 planar tab 16, as first straw contact finger cutout 31 and second straw contact finger cutout 32.

It is further contemplated herein that each of first straw contact finger 31 and second straw contact finger 32 is separated by slit 25, and first straw contact finger 31 and second straw contact finger 32 cutout endpoints converge on second slit end 27.

It is further contemplated herein in a preferred embodiment that first straw contact finger 31 and said second straw contact finger 32 cutout starting points are evenly spaced about slit 25 and perpendicular to said first slit end of said straw capture and alignment port 20.

It is further contemplated herein that one of first tab section 21 and second tab section 22 may include straw contact finger 30 to removably secure straw S, 18 against straw contact rim 40.

It is further contemplated herein that first straw contact finger 31 and second straw contact finger 32 may include upper and lower surfaces 60, such as first straw contact finger 31 may include first finger upper surface 61, second straw contact finger 32 may include second finger upper surface 62 hingedly or flexibly utilized to grip, contact and secure straw S, 18 therein straw capture cavity 50 by forcing or thrusting straw S, 18 therein straw capture cavity 50.

It is further contemplated herein that first straw contact finger 31 and second straw contact finger 32 may be configured to removably secure straw S, 18 therein straw capture cavity 50 without the need to contact straw contact rim 40.

Moreover, lid L material selection may include properties of flexibility to provide hingeability (hingeable), flexibility, and bendability, such as hinge 70 movement to enable biasing of components therein to enable repeated gripping and release forces of straw S, 18 therein, such as hinge 70 between first tab section 21 and first straw contact finger 31 and between second tab section 22 and second straw contact finger 32. Furthermore, preferably the end point of cutouts therein first tab section 21 and second tab section 22 forming first straw contact finger 31 and second straw contact finger 32 are preferably configured centered on a centerline CL of, for example, each arch section of straw capture and alignment port 20, respectively and proximate tangent line TL from arc or bullnose of straw capture and alignment port 20 or perpendicular to, as shown in FIG. 2.2.

It is further contemplated herein that first straw contact finger 31 and second straw contact finger 32 may be configured in any size or shape to provide surface area contact and/or edge contact with straw S, 18 to removably hold or secure straw S, 18 therein straw capture cavity 50.

It is still further contemplated herein that straw contact rim 40 may be configured in any size or shape to provide surface area contact and or edge contact with straw S, 18 to removably hold or secure straw S, 18 therein straw capture cavity 50 of straw gripper and tab separator 10.

Moreover, straw capture cavity 50 is not an opening in its non-use state but closed and ready to receive straw S, 18. Straw capture cavity 50 is preferably sized to be approximately similar to the shape of straw S, 18 such that the straw S may be placed inside straw gripper and tab separator 10 by sliding from above or below or by being pressed from outside in straw capture cavity 50 to be removably held in place.

It is still further contemplated herein that first tab section 21 and first straw contact finger 31 and second tab section 22 and second straw contact finger 32 may include ridges and/or concave or convex shapes formed therein to strengthen straw gripper and tab separator 10.

It is still further contemplated herein that straw S may include a straw wrapper (the straw S) together identified as straw S which may be removably secured therein straw gripper and tab separator 10.

It is still further contemplated herein that straw gripper and tab separator 10 may be utilized to grip a spoon, fork, chopsticks, or other utensils, for example, if beverage B includes a frozen, thick, hot, meal, or other beverage-like contents requiring such utensils (collectively represented as the 'straw S'). This and other straw S configurations (side surface or cross-section) are contemplated herein to be gripped by therein straw gripper and tab separator 10.

Figure 3:
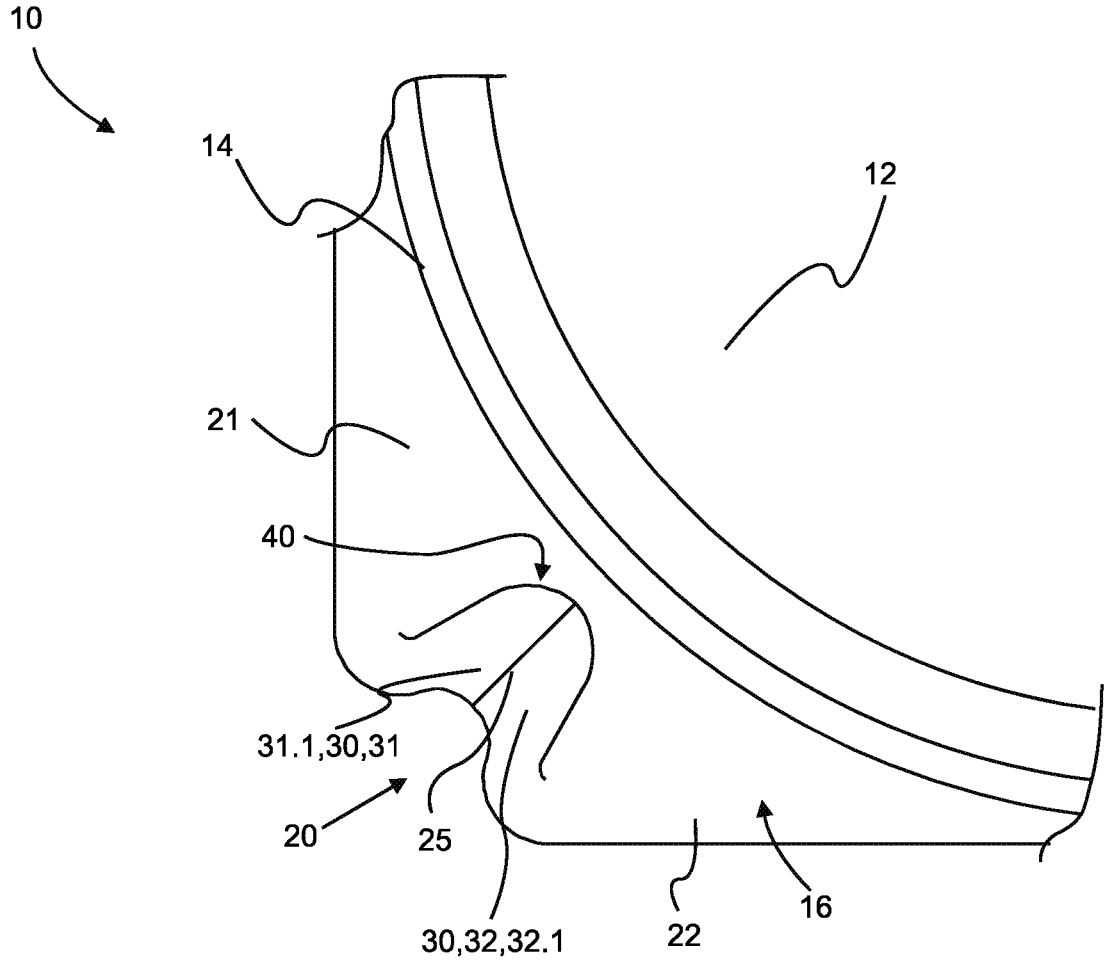
FIG. 3 is an exploded top view of an exemplary embodiment of the straw gripper and tab separator showing straw gripping finger(s) according to select embodiments of the disclosure in FIG. 2.
Figure 4:
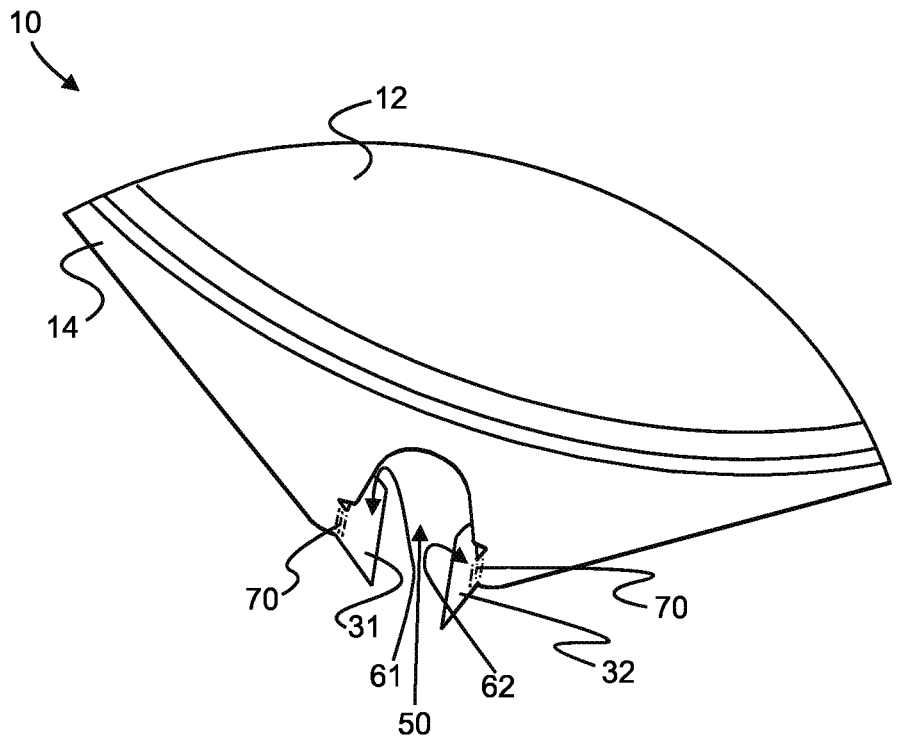
FIG. 4 is an exploded top view of an exemplary embodiment of the straw gripper and tab separator showing straw capture cavity according to select embodiments of the disclosure in FIG. 2.
Figure 5:
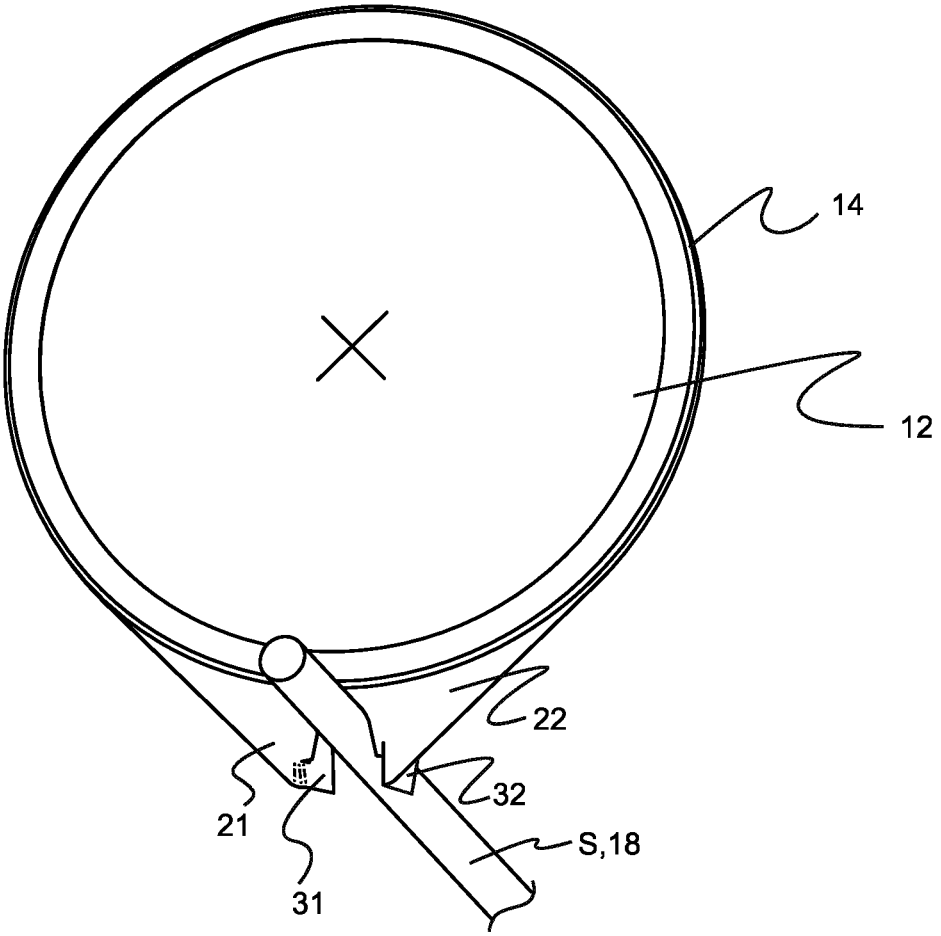
FIG. 5 is a perspective top view of an exemplary embodiment of the straw gripper and tab separator showing straw held by straw gripping finger(s) in straw capture cavity according to select embodiments of the disclosure in FIG. 2.
Figure 6:
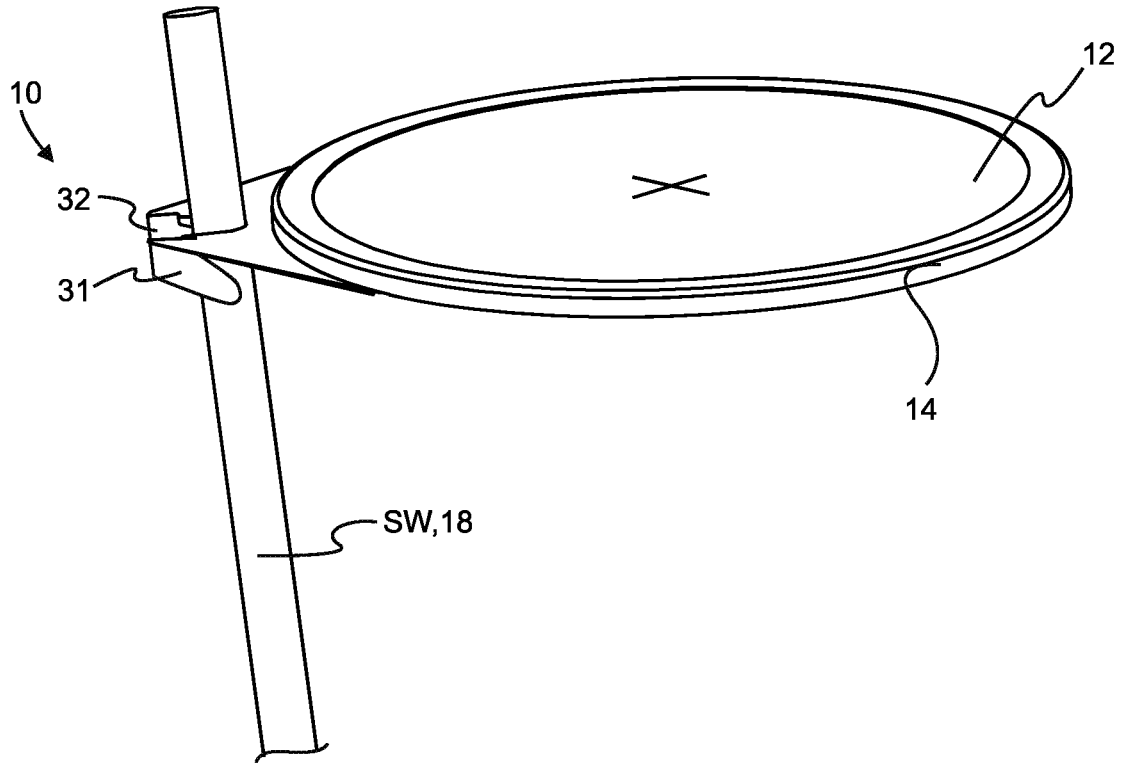
FIG. 6 is a perspective side view of an exemplary embodiment of the straw gripper and tab separator showing straw held by straw gripping finger(s) in straw capture cavity according to select embodiments of the disclosure in FIG. 2.

FIGS. 3.1, 3.2, 3.3, 3.4, and 3.5, by way of example, and not limitation, there is illustrated an alternate embodiment of straw gripper and tab separator 10.*n* and its parts, according to select embodiments.

FIG. 3.1 illustrates a necktie configuration, such as straw gripper and tab separator 10.3 may include angled straw capture and alignment port 20, one or more foldable or hingeable straw contact members or flaps, such as straw contact finger(s) 30, such as first straw contact finger 31 and second straw contact finger 32 formed from angled cuts, separated by angled slits 25, and angled or tent configuration of back rim wall, such as straw contact rim 40.

FIG. 3.2 illustrates a slit-eyed smile configuration, such as straw gripper and tab separator 10.4 may include straw capture and alignment port 20, one or more foldable or hingeable straw contact members or flaps, such as straw contact finger(s) 30, such as first straw contact finger 31 and second straw contact finger 32 formed from angled cuts, separated by slit 25, and angled or tent with gaps to form additional hinge 70 configuration of back rim wall, such as straw contact rim 40.

FIG. 3.3 illustrates a barrel and cross configuration, such as straw gripper and tab separator 10.5 may include semi-circular straw capture and alignment port 20, one or more foldable or hingeable straw contact members or flaps, such as straw contact finger(s) 30, such as first straw contact finger 31, second straw contact finger 32, third straw contact finger 33, and fourth straw contact finger 34 formed from arc cuts, separated by cross slits 25, and back rim wall, such as straw contact rim 40.

FIG. 3.4 illustrates an oval-eyed frown configuration, such as straw gripper and tab separator 10.6 may include angled straw capture and alignment port 20, one or more foldable or hingeable straw contact members or flaps, such as straw contact finger(s) 30, such as first straw contact finger 31 and second straw contact finger 32 separated by slit 25, and back rim wall, such as straw contact rim 40. Moreover, straw gripper and tab separator 10.6 may include holes, such as aperture 80, or more specifically, first aperture 81 and second aperture 82, therein first straw contact finger 31 and second straw contact finger 32, respectively.

FIG. 3.5 illustrates a barrel and cross configuration, such as straw gripper and tab separator 10.7 may include semi-circular straw capture and alignment port 20, one or more foldable or hingeable straw contact members or flaps, such as straw contact finger(s) 30, such as first straw contact finger 31 and second straw contact finger 32, formed from arc cuts, separated by gap slit 25, and back rim wall, such as straw contact rim 40.

Moreover, other configurations of straw gripper and tab separator 10 having one or more straw contact finger(s) 30, separated by slit(s) 25 and the like, known to one of ordinary skill in the art are contemplated herein.

Figure 7:
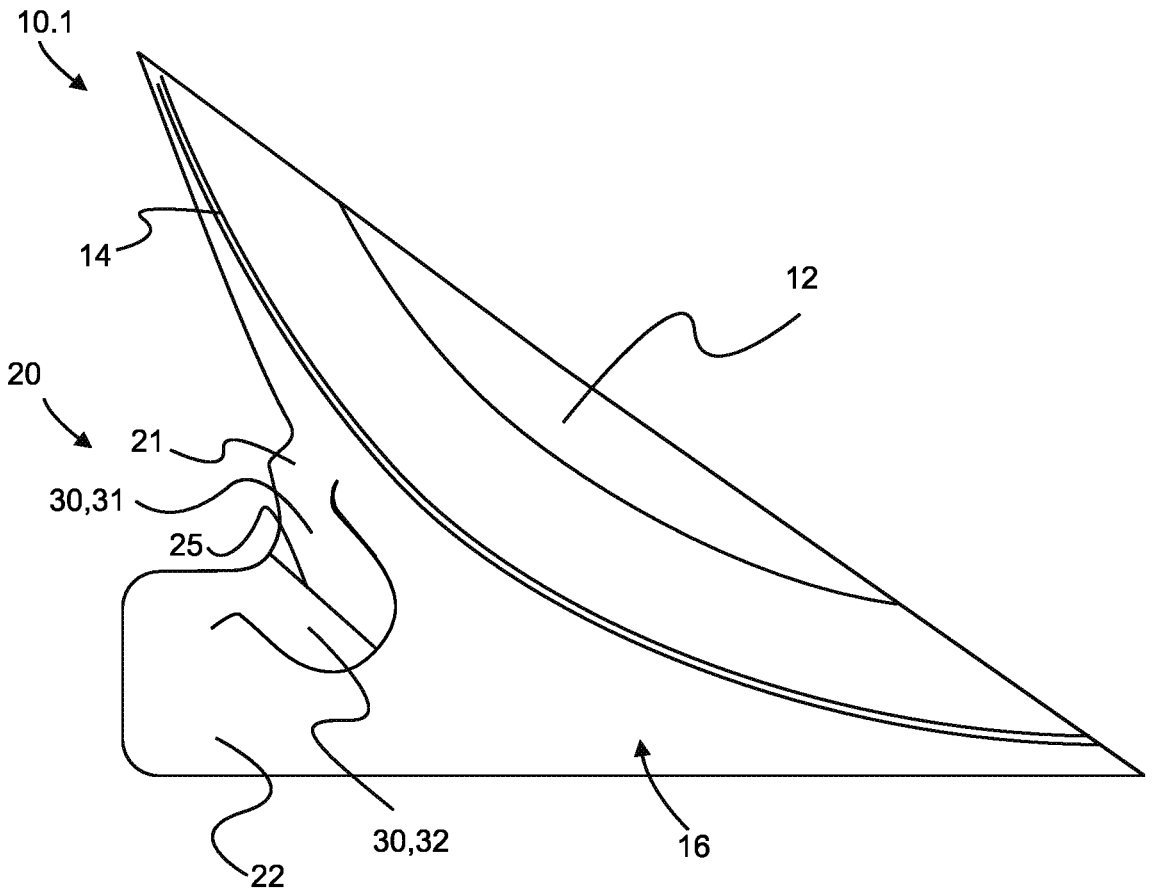
FIG. 7 is an exploded top view of an alternate exemplary embodiment of a drink lid with a straw gripper and tab separator shown as a side entry according to select embodiments of the disclosure.

Referring now to FIG. 7, by way of example, and not limitation, there is illustrated a second example embodiment of an apparatus to seal cup C having a rim R, such as drink lid of FIG. 1 with a straw support structure or apparatus integrated thereto, such as straw gripper and tab separator 10.1 and its parts, according to select embodiments. In this second embodiment, lid L may include a protruding planar tab 16 having straw gripper and tab separator 10 protruding from one or more locations along perimeter flange 14 of lid 12. Furthermore, planar tab 16 may include a cutout therein, such as slit 25 dividing planar tab 16 into left or first tab section 21 and right or second tab section 22, each extending as flat planar tab therefrom perimeter flange 14 of lid 12. Slit 25 may include front or first slit end 26 and back or second slit end 27. First tab section 21 and second tab section 22 may each include a portion of straw capture and alignment port 20 configured as the front end or exterior edge 23 of first tab section 21 and second tab section 22. In this embodiment, straw capture and alignment port 20 may be pointed or face circumferentially adjacent, parallel to, or tangential and proximate perimeter flange 14 of lid 12.

In this embodiment, first straw contact finger 31 and second straw contact finger 32 may be pointed or face toward or in the direction of parallel to perimeter flange 14 of lid 12 or the tangent thereof.

Still furthermore, one or both of first tab section 21 and second tab section 22 may include a series of cuts or cutouts centered relative to straw capture and alignment port 20 to form one or more foldable or hingeable straw contact members, such as straw contact finger(s) 30 extending in a direction be pointed or face circumferentially adjacent or tangential and proximate perimeter flange 14 of lid 12 and hinged thereto first tab section 21 proximate straw capture port 20. In a preferred embodiment, first tab section 21 may include first straw contact finger 31 and second tab section 22 may include second straw contact finger 32 centered about slit 25 and meeting together at second slit end 27 to create an opening or access therebetween first straw contact finger 31 and second straw contact finger 32. Slit 25 is preferably formed with first straw contact finger 31 and second straw contact finger 32 touching or virtually touching one another or close thereto and pointed or face circumferentially adjacent or tangential and proximate perimeter flange 14 of lid 12. Moreover, first end 31.1 of first straw contact finger 31 may be connected and hinged to first tab section 21 and first end 32.1 of second straw contact finger 32 may be connected and hinged to second tab section 22. Furthermore, first straw contact finger 31 and second straw contact finger 32 may extend therein straw capture port 20 and hingedly or flexibly fold therein to form straw capture cavity 50 formed between hinged first straw contact finger 31 and second straw contact finger 32, and back rim wall of straw contact rim 40. Straw contact rim 40 may be sized and shaped to match the outer surface configuration of straw S, 18. Moreover, straw contact rim 40 is preferably pointed or face circumferentially adjacent or tangential and proximate perimeter flange 14 of lid 12.

Figure 8:
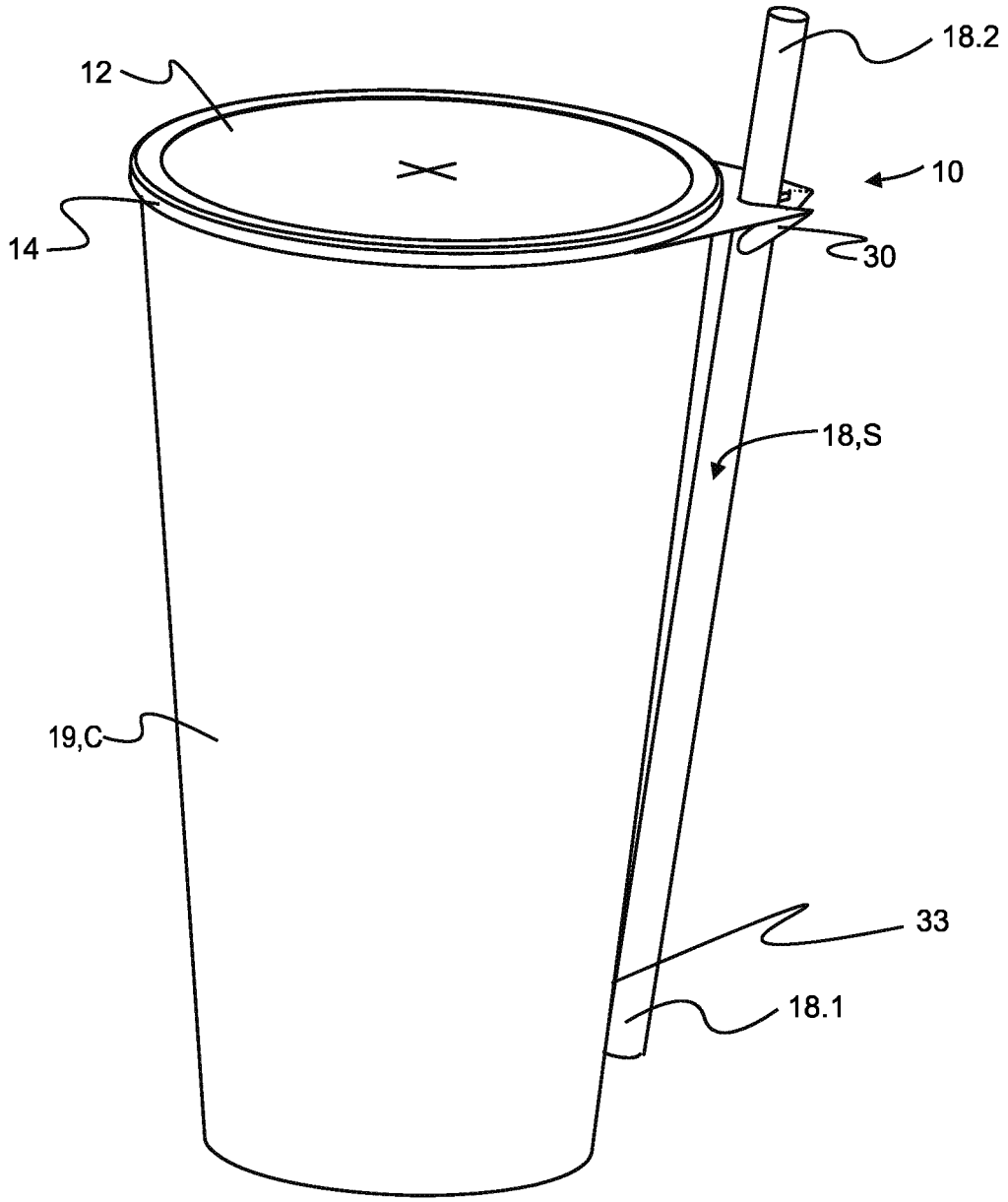
FIG. 8 is a perspective side view of an alternate exemplary embodiment of a drink lid with a straw gripper and tab separator, straw, and cup in use according to select embodiments of the disclosure.

Referring now to FIG. 8, by way of example, and not limitation, there is illustrated an example embodiment of an apparatus to seal cup C, such as drink lid L with a straw support structure or apparatus integrated thereto, such as straw gripper and tab separator 10, 10.1, 10.3, 10.4, 10.5, 10.6. In use lid L may be affixed to rim R of cup C, 18. Preferably, straw gripper and tab separator 10, 10.1, 10.3, 10.4, 10.5, 10.6 removably grips, secures or holds straw 18, S proximate first straw end 18.1 with at least two points of contact, such as any two of first straw contact finger 31, second straw contact finger 32, and/or back rim wall of straw contact rim 40, as well as second straw end 18.2 may be in contact with lower end of sidewall SW of cup C, 19 to provide an additional contact point, such as third point of contact 33 for straw 18, S, such point of contact assists with preventing second straw end 18.2 from being contacted and, thus, bumping straw 18, S out of straw gripper and tab separator 10, 10.1, 10.3, 10.4, 10.5, 10.6.

Figure 9:
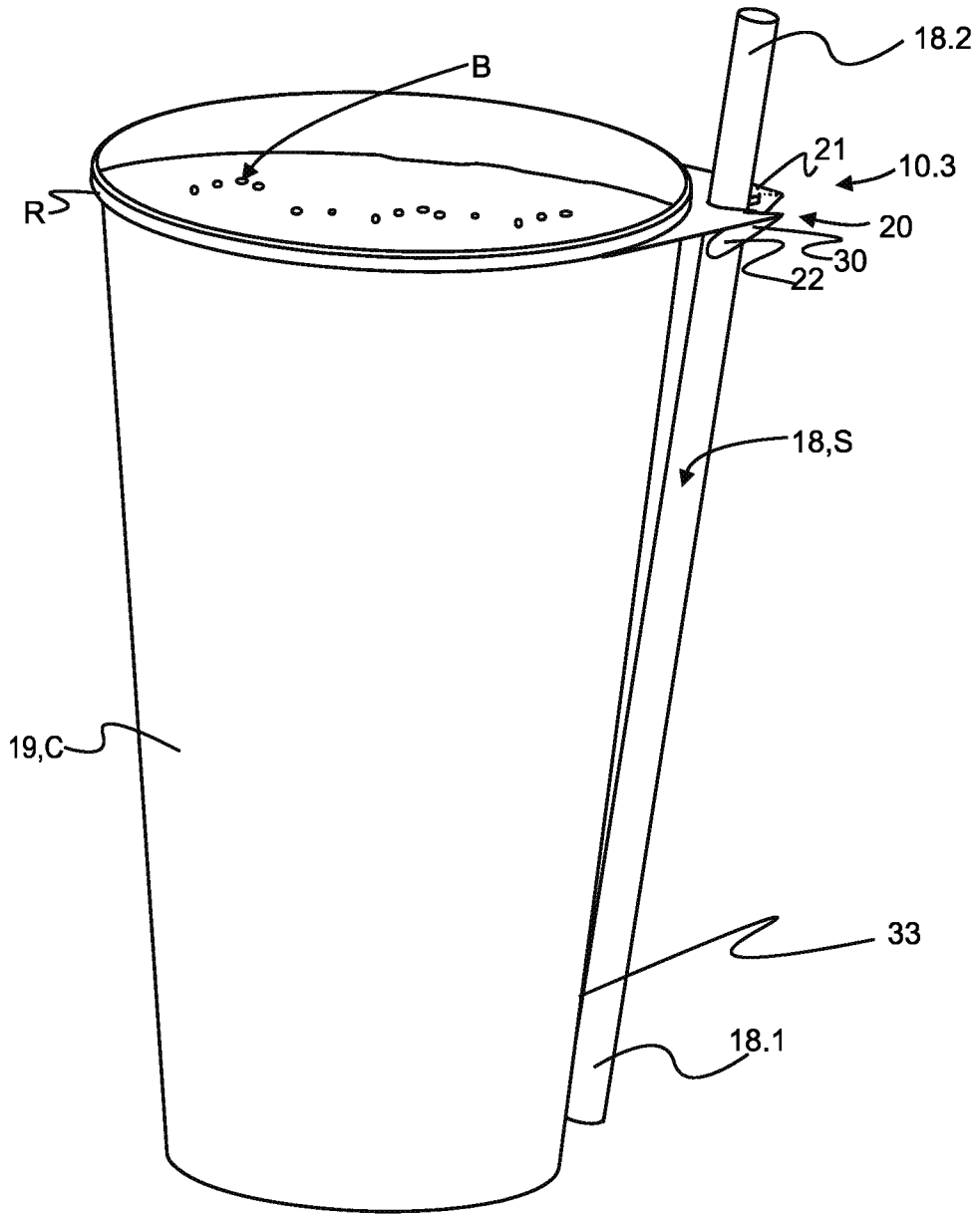
FIG. 9 is a perspective side view of an alternate exemplary embodiment of the straw gripper and tab separator showing straw held by straw gripping finger(s) in straw capture cavity affixed to the rim of the cup, according to select embodiments of the disclosure.

Referring now to FIG. 9, by way of example, and not limitation, there is illustrated a third example embodiment of an apparatus cup C having a rim R, with a straw support structure or apparatus integrated thereto, such as straw gripper and tab separator 10.2. In this third embodiment, cup C, 19 may include rim R, 17 where beverage lid 12 having perimeter flange 14 configured to conformingly couple to a top periphery or rim R of a container, such as cup C for covering the container's opening to prevent the beverage B from spilling, sloshing, or splashing out of the cup C. Moreover, rim R, 17 may include a protruding planar tab 16 having straw gripper and tab separator 10.2 protruding from one or more locations along perimeter rim R, 17. If possible, straw gripper and tab separator 10.2 may preferably utilize an area of material in the manufacturing form that is otherwise cut away in the production process. Furthermore, planar tab 16 may include left or first tab section 21 and right or second tab section 22, each extending as a flat planar tab 16 therefrom perimeter flange 14 of lid 12. First tab section 21 and second tab section 22 may include an indent or straw alignment notch therebetween, such as straw capture and alignment port 20 configured as the circumferential facing edge of first tab section 21 and second tab section 22, which is pointed or faces circumferentially adjacent or proximate perimeter flange 14 of lid 12.

Still furthermore, one or both of first tab section 21 and second tab section 22 may include a series of cuts or narrow slots proximate as well as may be centered relative to straw capture and alignment port 20 to form one or more foldable or hingeable straw contact members, such as straw contact finger(s) 30 extending in a direction pointed or faces circumferentially adjacent or proximate perimeter flange 14 of lid 12 and hinged thereto first tab section 21 proximate straw capture port 20. In a preferred embodiment, first tab section 21 may include first straw contact finger 31, and second tab section 22 may include second straw contact finger 32, with an opening between fingers, such as slit 33 therebetween first straw contact finger 31 and second straw contact finger 32. Moreover, first end 31.1 of first straw contact finger 31 may be connected and hinged to first tab section 21 and first end 32.1 of second straw contact finger 32 may be connected and hinged to second tab section 22. Furthermore, first straw contact finger 31 and second straw contact finger 32 may extend therein straw capture port 20 and hingedly or flexibly fold or bend therein to form straw capture cavity 50 formed between hinged first straw contact finger 31 and second straw contact finger 32, and back rim wall of straw contact rim 40. Straw contact rim 40 may be sized and shaped to match the outer surface configuration of straw S, 18.

It is still further contemplated herein that straw gripper and tab separator 10 may be an integrated feature of cup C—either along a sidewall SW or rim R—to hold or releasably attach straw S, 18 vertically to the outside of cup C.

Concerning the description herein, it is to be realized that the optimum dimensional relationships, including variations in size, materials, shape, form, configuration, position, connection, function and manner of operation, assembly and use, are intended to be encompassed by the present disclosure.

It is further understood herein that the parts and elements of this disclosure may be located or positioned elsewhere based on one of ordinary skill in the art without deviating from the present disclosure.

With respect to the above description, it is to be realized that the optimum dimensional relationships, including variations in size, materials, shape, form, position, movement mechanisms, function and manner of operation, assembly and use, are intended to be encompassed by the present disclosure.

The foregoing description and drawings comprise illustrative embodiments. Regarding the described exemplary embodiments, it should be noted by those skilled in the art that the disclosures within are exemplary only, and that various other alternatives, adaptations, and modifications may be made within the scope of the present disclosure. Merely listing or numbering the steps of a method in a particular order does not constitute any limitation on the order of the steps of that method. Many modifications and other embodiments will come to mind for one skilled in the art this disclosure pertains to, having the benefit of the teachings presented in the foregoing descriptions and the associated drawings. Although specific terms may be employed herein, they are used in a generic and descriptive sense only and not for purposes of limitation. Moreover, the present disclosure has been described in detail; it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. An apparatus to secure a straw to a cup lid having a perimeter flange; the cup lid is secured to a rim of a drinking cup having a sidewall, said apparatus comprising:

a substantially horizontal planar tab extends outwardly from the perimeter flange of the cup lid, said substantially horizontal planar tab having an exterior edge with a straw capture and alignment port;

said straw capture and alignment port having a slit to divide said planar tab into a first tab section and second tab section, said slit having a first slit end and a second slit end;

said first tab section having a first substantially horizontal straw contact finger configured therein and said second tab section having a second substantially horizontal straw contact finger configured therein, each said first substantially horizontal straw contact finger and said second substantially horizontal straw contact finger separated by said slit, endpoints of cutouts of said first substantially horizontal straw contact finger and said second substantially horizontal straw contact finger converge on said second slit end; and said first substantially horizontal straw contact finger and said second substantially horizontal straw contact finger are hingeably configured to removably secure the straw against a straw contact rim formed in said planar tab by a cutout of said first substantially horizontal straw contact finger and said second substantially horizontal straw contact finger.

2. The apparatus of claim 1, wherein said alignment port is semicircular.

3. The apparatus of claim 1, wherein said straw capture and alignment port points outward from a center of the cup lid.

4. The apparatus of claim 1, wherein said cutout starting points of said first substantially horizontal straw contact finger and said second substantially horizontal straw contact finger are evenly spaced about said slit and perpendicular to said first slit end of said straw capture and alignment port.

5. The apparatus of claim 1, wherein said straw capture and alignment port, said first substantially horizontal straw contact finger, said slit, and said second substantially horizontal straw contact finger are configured perpendicular to the perimeter flange.

6. The apparatus of claim 1, wherein said straw capture and alignment port, said first substantially horizontal straw contact finger, said slit, and said second substantially horizontal straw contact finger are configured parallel to the perimeter flange.

7. The apparatus of claim 1, wherein said first substantially horizontal straw contact finger and said second substantially horizontal straw contact finger are hingeably configured about said slit to fold therein to form straw capture cavity.

8. The apparatus of claim 1, wherein said straw contact rim, said first substantially horizontal straw contact finger and said second substantially horizontal straw contact finger are hingeably configured about said slit to fold therein to form straw capture cavity.

9. The apparatus of claim 1, wherein at least two of said straw contact rim, said first substantially horizontal straw contact finger and said second substantially horizontal straw contact finger are hingeably configured about said slit to fold therein to form straw capture cavity.

10. The apparatus of claim 1, wherein said first substantially horizontal straw contact finger and said second substantially horizontal straw contact finger are sized and shaped to match the straw configuration.

11. The apparatus of claim 1, wherein said straw contact rim is sized and shaped to match the straw configuration.

12. The apparatus of claim 1, wherein said first substantially horizontal straw contact finger and said second substantially horizontal straw contact finger having an upper surface to grip the straw.

13. The apparatus of claim 1, wherein at least two of said straw contact rim, said first substantially horizontal straw contact finger, said second substantially horizontal straw contact finger are hingeably configured about said slit to fold therein to grip the straw therein.

14. The apparatus of claim 13, further comprising a second straw end in contact with the sidewall of the cup.

15. An apparatus to secure a straw to a rim of a drinking cup having a sidewall, said apparatus comprising:

a substantially horizontal planar tab extends outwardly from the rim of the drinking cup, said substantially horizontal planar tab having an exterior edge with a straw capture and alignment port;

said straw capture and alignment port having a slit to divide said planar tab into a first tab section and second tab section, said slit having a first slit end and a second slit end;

said first tab section having a first substantially horizontal straw contact finger configured therein and said second tab section having a second substantially horizontal straw contact finger configured therein, each said first substantially horizontal straw contact finger and said second substantially horizontal straw contact finger separated by said slit, cutout end points of said first substantially horizontal straw contact finger and said second substantially horizontal straw contact finger converge on said second slit end; and said first substantially horizontal straw contact finger and said second substantially horizontal straw contact finger are hingeably configured to removably secure the straw against a straw contact rim formed in said planar tab by a cutout of said first substantially horizontal straw contact finger and said second substantially horizontal straw contact finger.

16. The apparatus of claim 15, wherein said cutout starting points of said first substantially horizontal straw contact finger and said second substantially horizontal straw contact finger cutout starting points are evenly spaced about said slit and perpendicular to said first slit end of said straw capture and alignment port.

17. The apparatus of claim 15, wherein said straw capture and alignment port, said first substantially horizontal straw contact finger, said slit, and said second substantially horizontal straw contact finger are configured perpendicular to the rim.

18. The apparatus of claim 15, wherein said straw capture and alignment port, said first substantially horizontal straw contact finger, said slit, and said second substantially horizontal straw contact finger are configured parallel to the rim.

19. The apparatus of claim 15, wherein at least two of said straw contact rim, said first substantially horizontal straw contact finger and said second substantially horizontal straw contact finger are hingeably configured about said slit to fold therein to form straw capture cavity.

20. The apparatus of claim 15, wherein at least two of said first substantially horizontal straw contact finger, said second substantially horizontal straw contact finger, and said-straw contact rim are hingeably configured about said slit to fold therein to grip the straw therein.

21. The apparatus of claim 20, further comprising a second straw end in contact with the sidewall of the cup.

* * * * *